US005173963A

United States Patent [19]

Greenberg

[11] Patent Number: 5,173,963

[45] Date of Patent: Dec. 29, 1992

[54] PROTECTIVE BAND FOR THE HAND

[76] Inventor: Bert Greenberg, 2030 South Ocean Dr., Hallandale, Fla. 33009

[21] Appl. No.: 747,129

[22] Filed: Aug. 19, 1991

[51] Int. Cl.[5] ..... A41D 13/00

[52] U.S. Cl. ..... 2/20; 2/19

[58] Field of Search ..... 2/20, 161 A, 19, 159, 2/158, 161 R, 16, 160, 163

[56] References Cited

U.S. PATENT DOCUMENTS

| | | | |
|---|---|---|---|
| 1,465,223 | 8/1923 | Kobbe | 2/19 X |
| 1,479,771 | 1/1924 | Campbell | 2/20 |
| 1,887,278 | 11/1932 | Auster | 2/20 |
| 2,244,445 | 6/1941 | Carson et al. | 2/20 |
| 2,845,628 | 8/1958 | Dell | 2/20 |
| 3,066,306 | 12/1962 | Thomas | 2/20 |
| 3,146,463 | 9/1964 | Wargo | 2/20 |
| 3,890,648 | 6/1975 | Beal | 2/20 |
| 4,617,684 | 10/1986 | Green et al. | 2/20 |
| 4,850,341 | 7/1989 | Fabry et al. | 2/161 R X |
| 4,947,486 | 8/1990 | Hsuih | 2/164 |

*Primary Examiner*—Andrew M. Falik
*Assistant Examiner*—Sara M. Current
*Attorney, Agent, or Firm*—McAulay, Fisher, Nissen, Goldberg & Kiel

[57] ABSTRACT

A protective device for the hand is disclosed in the form of an elastic band having a palm portion adapted to be fitted around and cover a portion of the palm of a wearer's hand. An elastic index portion extends upwardly from the palm portion and is adapted to be fitted around and cover a portion of the wearer's index finger. A resilient pad is affixed to the palm portion and extends into the index portion sufficiently to cover the knuckle of the wearer's index finger when the device is worn. The configuration is such that the pad serves to absorb impact forces and redistribute them over a greater area of the wearer's hand when the device is worn to reduce tissue trauma.

2 Claims, 2 Drawing Sheets

PROTECTIVE BAND FOR THE HAND

BACKGROUND OF THE INVENTION

I. Field of the Invention

This invention relates generally to a protective band for the hand and, more specifically, to an elastic protective band having a resilient pad to absorb impact forces and redistribute them over a greater area of the wearer's hand when the band is worn to reduce tissue trauma.

II. Description of the Prior Art

Heretofore, it is known to provide protective devices having resilient, cushioning material which may be positioned or worn on a wearer's hand to absorb and redistribute impact forces over a greater area of the hand. For example, in the game of baseball or softball, the catcher typically places a sponge material over his or her palm prior to inserting the hand into a catcher's glove or mitt. The sponge has the effect of transmitting the impact forces generated by the ball hitting the glove over a greater area of the hand thereby reducing tissue trauma and pain at the point of impact. In place of the sponge, the catcher could use an elastomerioc member soft rubber.

The disadvantage in using a sponge or rubber-like member is that the cushioning effect of the member deteriorates fairly quickly upon repeated impact which requires that the member be replaced quite frequently. Also, there is a tendency for the member to move-about upon impact of the ball, after initial placement in the palm of the wearer's hand, so that the member has to be frequently repositioned to achieve the desired effect. Failure to properly position or reposition the member, as necessary, will subject the catcher to considerable discomfort and possible serious injury upon impact of the ball. Still further, there is a tendency for the sponge to become lost or misplaced since it is a free member in that it is not connected or otherwise secured to the wearer's palm.

It also is known to wear a glove having a cushioning or resilient pad formed as part of the glove to distribute impact forces to the wearer's hand. Such gloves typically are worn by batters to distribute the impact force of the ball hitting the bat more evenly over the hands. However, it is not practical to wear such a batting glove under a catcher's or fielder's glove since it interferes with the flexing of the fingers of the fielder's glove thereby resulting in a loss in the control and feel of the fielder's glove.

There also are padded athletic gloves, such as those used by weight lifters, which are fingerless. That is, the finger receiving portions are cut off or eliminated. While such gloves may be suitable for their intended purpose, they are not constructed to take the wear and tear of repeated high impact forces generated by a ball travelling at speeds up to 100 mph. The seams of such gloves simply do not stand up to such impact. These gloves, unlike applicant's protective band, also are not overly elastic in construction which requires the manufacture of such gloves in multiple sizes to cover a wide range of hand sizes. This, in turn, requires the vendor to stock a large inventory of gloves which is costly both in terms of the number of gloves one has to buy and the space needed for storage. In contrast, applicant's band preferably is elastic in construction which permits one size to fit a multiple of hand sizes within a given range.

The present invention improves on the heretofore known protective devices in the manner hereinafter described.

SUMMARY OF THE INVENTION

The protective device of the present invention is in the form of an elastic band having a palm portion and a rear portion which together define a completed band having an upper edge. The palm portion is adapted to be fitted around and cover at least a portion of the palm of the wearer's hand. An elastic index portion extends upwardly from the upper edge of the band and is adapted to be fitted around and cover a portion of the wearer's index finger. A resilient pad is affixed to the palm portion and extends into the index portion sufficiently to cover the lower knuckle of the wearer's index finger when the device is worn.

The palm portion and the rear portion are connected at respective points adjacent the upper edge of the band corresponding to the junctures of the wearer's index and middle fingers and the wearer's fourth and fifth fingers when the device is worn to enhance the positioning of the device on the wearer's hand. Also, the upper edge of the band is positioned approximately at the juncture between the palm and the middle and fourth fingers of the wearer's hand when the device is worn so that the palm portion of the band does not interfere with the flexing of the wearer's middle and fourth fingers. The configuration is such that the pad serves to absorb impact forces and redistribute them over a greater area of the wearer's hand when the band is worn to reduce tissue trauma.

Additional features and advantages of the present invention will become more apparent from a consideration of the following detailed description when taken in conjunction with the accompanying drawings.

DESCRIPTION OF THE PREFERRED EMBODIMENT

Figure 1:
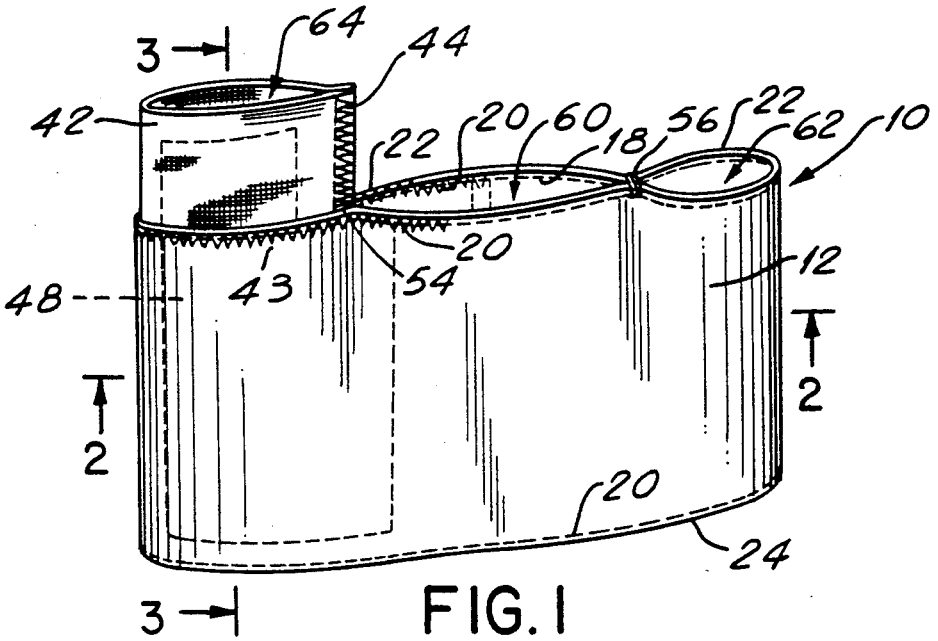
FIG. 1 is a perspective view of the protective band for the hand constructed in accordance with the present invention.
Figure 2:
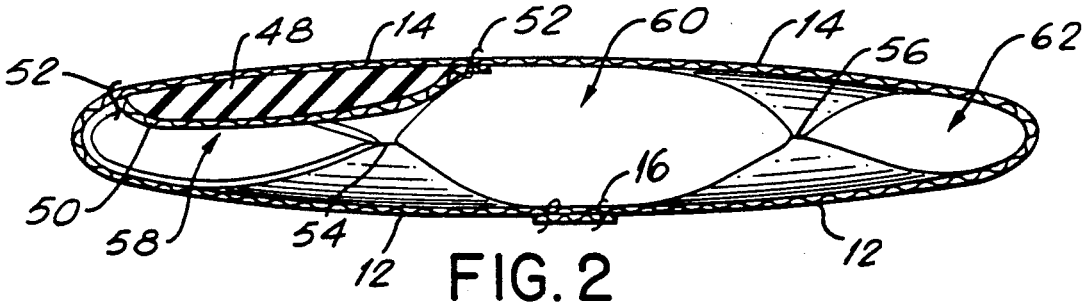
FIG. 2 is a sectional view taken through line 2—2 of FIG. 1.
Figure 3:
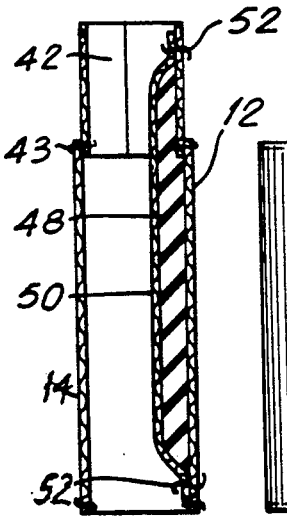
FIG. 3 is a sectional view taken through line 3—3 of FIG. 1.
Figure 4:
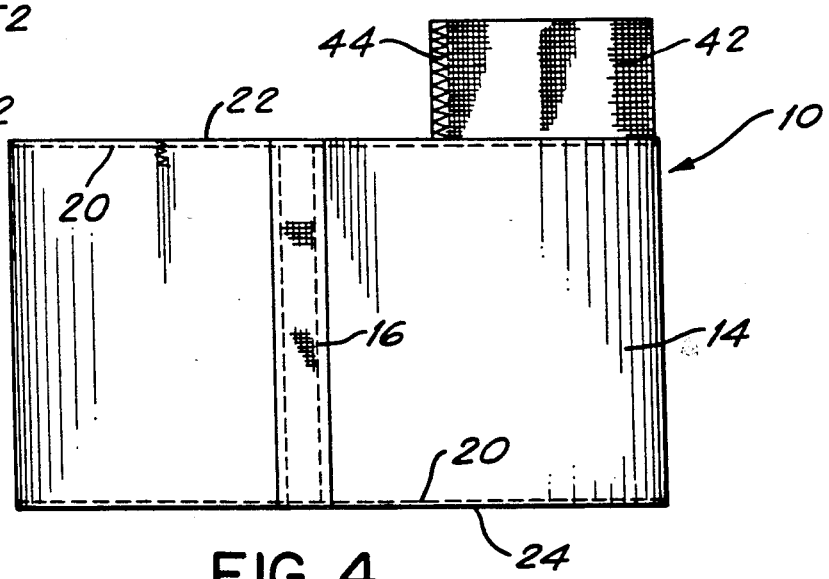
FIG. 4 is a rear elevational view of the protective band shown in FIG. 1.

Referring to the drawings, numeral 10 represents a protective band constructed in accordance with the present invention adapted to be worn on a wearer's hand. Band 10 is constructed having a front portion 12 and a rear portion 14 joined together at the rear portion along seams 16 to form an endless band.

The front and rear portions 12 and 14 of band 10 are made of flexible, elastic material, such as woven or knitted fabric having elastic yarn. The material of the inner surface 18 of band 10 is relatively smooth as compared to the material of the outer surface for purpose of comfort in wearing the band. The material forming the inner and outer surfaces are joined together by means of stitching 20 along the upper and lower edges 22 and 24, respectively, of the band.

For the embodiment shown, the band has a circumferential extent of approximately 8.0 inches (20.32 cm) in the non-stretched condition and a width or height of approximately 2.25 inches (5.72 cm). The aforesaid dimensions are purely illustrative and are not to be deemed limitations on the invention. As will be hereinafter noted in connection with the description of FIG. 5, band 10 is intended to be fitted around the palm portion of the wearer's hand in a stretched condition. As such, the band will accommodate hands of different sizes within a given range. However, since the size of a wearer's hand varies from person to person, it is envisioned that the band need only be constructed of three circumferential lengths to accommodate small, medium, and large size hands.

Figure 5:
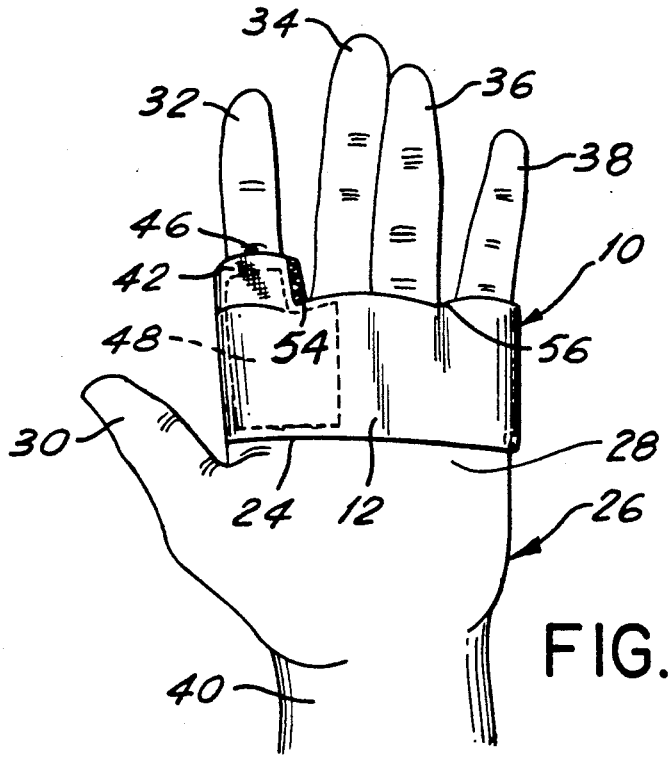
FIG. 5 is a front elevational view of the protective band shown in FIG 1, on a reduced scale, positioned on a wearer's hand.

Front portion 12 may also be regarded as a palm portion since, when band 10 is fitted around the wearer's hand 26 as shown in FIG. 5, palm portion 12 covers at least a portion of the wearer's palm 28. That is, if we regard the fingers or digits of hand 26 being made up of thumb finger 30, index finger 32, middle finger 34, fourth finger 36 and fifth finger 38, then palm portion 12 may be regarded as covering the concave part of the hand between the base of the finger 30–38 and the wrist 40.

An elastic index portion 42 extends upwardly from the upper edge 22 of band 10 and is secured thereto by stitching 43. Index potion 42 may be made of the same material as front and rear portions 12 and 14 of band 10, and is tubular in shape closed by seam stitching 44. For the embodiment shown, the catcher is assumed to be right-handed. That is, the catcher throws the ball with the right hand and catches with the left hand. That being the case, band 10 is shown worn on the left hand with the index portion 42 positioned to the left side of the band as viewed in the drawings, and adapted to be fitted around and cover a portion of the wearer's index finger 32 extending to the region of the middle knuckle 46. It will be appreciated that the positioning of index portion 42 would be opposite for a left-handed catcher so as to be on the right side of the band.

A resilient pad 48 is affixed to the inner surface 18 of palm portion 12 and positioned to the left side of band 10 as viewed in the drawings. The resilient pad extends for the width or height of the band and also extends into the index portion 42 of band 10 sufficiently to cover the lower knuckle of index finger 32 when band 10 is worn on the wearer's hand 26. As shown in FIG. 5, pad 48 extends upwardly into index portion 42 and terminates substantially at the distal end thereof approximate the middle knuckle 46 of index finger 32.

Pad 48 is secured in position by an elastic fabric liner material 50. That is, pad 48 is sandwiched between the inner surface 18 of palm portion 12 and the front inner surface of index portion 42, collectively representing one side of the sandwich, and the liner 50, representing the other side of the sandwich, and is secured in place by stitching 52. Pad 48 also extends in a transverse direction, that is in a direction corresponding to the circumferential extent of band 10, a preselected distance to cover the wearer's palm 28 depending on the intended use of the band. For example, in the embodiment shown where the band is worn on a baseball catcher's hand, it is only necessary for pad 48 to extend a distance to cover a zone of the palm portion 12 adjacent the wearer's index finger. This would correspond to a region below the middle finger 34. For other applications, such as where protection is sought for a greater area of the wearer's palm 28, pad 48 may extend further in the transverse direction to cover the region below the fifth finger 38.

Pad 48 preferably is made of a visco elastic polymer commercially available under the trademark AKTON from Action Products, Inc., Hagerstown, Md. The substance is an elastomeric non-flowing gel. In place of this substance, it may be possible to utilize a soft rubber substance as the padding material.

In order to facilitate positioning of band 10 on the wearer's hand 26, palm portion 12 and rear portion 14 are connected together at spaced points respectively adjacent the upper edge 22 of the band. These points are represented by stitching 54 and 56. The connection point represented by stitching 54 corresponds to the juncture of the wearer's index finger 32 and middle finger 34 when band 10 is positioned in place on hand 26. The connection point represented by stitching 56 corresponds to the juncture of the wearer's fourth finger 36 and fifth finger 38 when the band is worn.

Stitching 54 and 56 serve to partition the upper edge 22 of band 10 into three openings represented by numerals 58, 60 and 62, respectively. Opening 58 is substantially aligned with an opening 64 defined by the tubular index portion 42 of the band.

In use, the wearer's index finger 32 is received within the aligned openings 58 and 64 of band 10. The middle and fourth fingers 34 and 36 are received within opening 60 and the fifth finger 38 is received within the opening 62. Elastic band 10 stretches when it is positioned on the wearer's hand 26, as shown, with the stitched points 54 and 56 serving as pinched anchor points to prevent rotation of band 10 on hand 26 once the band is in place. Band 10 is thus firmly fitted to hand 26 with resilient pad 48 properly positioned to absorb the impact force of a ball hitting the so-called "pocket" of the catcher's glove 66 shown in phantom in FIG. 6. The impact force absorbed by pad 48 is redistributed over a greater area of the wearer's hand to reduce tissue trauma and pain at the point of impact.

Figure 6:
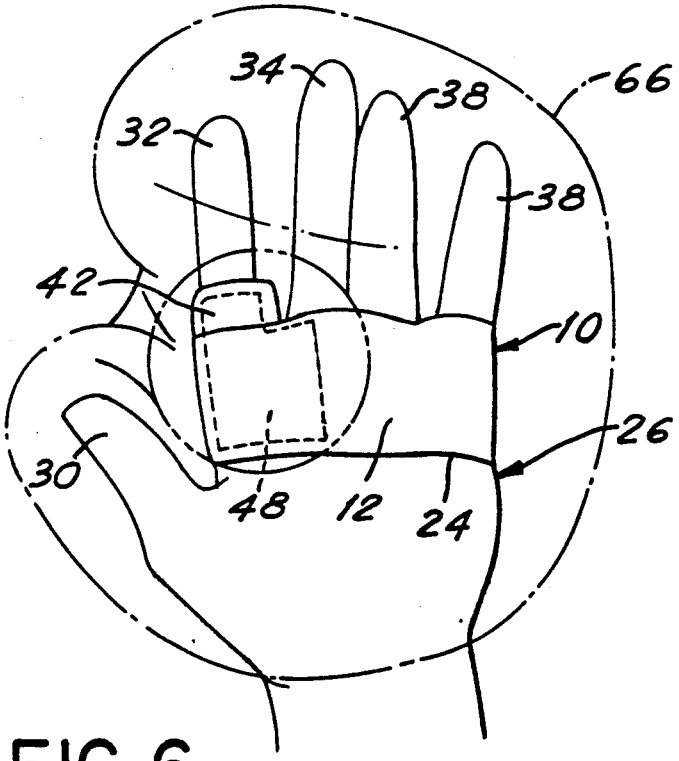
FIG. 6 is a view similar to FIG. 5 with the wearer's hand positioned in a catcher's baseball glove shown in phantom.

For added comfort and convenience, the dimensions of band 10 are selected such that the upper edge 22 is positioned approximately at the juncture between the wearer's palm 28 and the middle and fourth fingers 36 and 38, respectively, of the wearer's hand 26 when band 10 is worn as shown in FIGS. 5 and 6. With band 10 so positioned, the palm portion 12 does not interfere with the flexing of the wearer's middle and fourth fingers which, in turn, affords control in the handling of glove 66.

In the preferred embodiment, band 10 is shown as being endless. However, in place of seam stitching 16, the structure may be varied to provide the band with overlapping ends which are releasably secured to each other by interengaging hook and loop fasteners respectively provided on the overlapping mating ends of the band in a manner well known in the art. Also, whereas index portion 42 is shown as being connected to the palm portion 12 and rear portion 14 of band 10 by stitching 43, it is apparent that the index portion may be formed as an integral portion of the band representing extended portions of the palm and rear portions, respectively. It further will be appreciated that the protective band may be worn and used in conjunction with other type baseball gloves, and is not limited to use with only a catcher's glove. Still further, whereas it is preferred to have band 10 constructed of elastic material, it will be appreciated that the band may be of non-elastic material with overlapping interengaging ends to securely maintain the band in the proper orientation on the wearer's hand. It also is envisioned that the index portion may be positioned relative to the palm portion to fit around and cover a finger other than the index finger, such as, for example, the fifth finger of the wearer's hand. In such instance, the index portion would be more aptly described as a finger portion per se.

While a preferred embodiment of the invention has been shown and described in detail, it will be readily understood and appreciated that numerous omissions, changes and additions may be made without departing from the spirit and scope of the invention.

I claim:

1. A protective device for the hand adapted to be worn when the hand is positioned in a baseball glove, said device comprising:

an elastic band having a palm portion and a rear portion which together define a completed band having an upper edge;

said palm portion adapted to be fitted around and cover at least a portion of the palm of the wearer's hand;

an elastic index portion extending upwardly from the upper edge of said band, said index portion adapted to be fitted around and cover a portion of the wearer's index finger;

a resilient pad separate from and affixed to said palm portion, said resilient pad extending into the index portion of said band to an extent adjacent the middle knuckle of the wearer's index finger and extending along said palm portion to cover a zone of said palm portion adjacent to the wearer's index finger when the device is worn;

said palm portion and said rear portion being connected at spaced points respectively adjacent the upper edge of said band corresponding to the junctures of the wearer's index and middle fingers and the wearer's fourth and fifth fingers when the device is worn to maintain the positioning of said device on the wearer's hand;

the upper edge of said band being positioned approximately at the juncture between the palm and the middle and fourth fingers of the wearer's hand when said device is worn so that the palm portion of said band does not interfere with the flexing of the wearer's middle and fourth fingers;

said pad serving to absorb impact forces which occur when catching a ball in the glove and redistribute them over a greater area of the wearer's hand when said device is worn to reduce tissue trauma.

2. The device of claim 1, wherein said resilient pad is made of a visco elastic polymer.

* * * * *